US011555424B2

(12) United States Patent
Patil et al.

(10) Patent No.: US 11,555,424 B2
(45) Date of Patent: Jan. 17, 2023

(54) ENGINE BRAKING CASTELLATION MECHANISM

(71) Applicant: Eaton Intelligent Power Limited, Dublin (IE)

(72) Inventors: Santosh Patil, Pune (IN); Nikhil Kishor Saggam, Pune (IN); Matthew Vance, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 127 days.

(21) Appl. No.: 16/914,615

(22) Filed: Jun. 29, 2020

(65) Prior Publication Data

US 2020/0325803 A1 Oct. 15, 2020

Related U.S. Application Data

(63) Continuation of application No. PCT/US2018/067596, filed on Dec. 27, 2018.

(30) Foreign Application Priority Data

Dec. 29, 2017 (IN) ..... 201711047278
Mar. 3, 2018 (IN) ..... 201811007952

(51) Int. Cl.
*F01L 9/02* (2006.01)
*F01L 13/06* (2006.01)
(Continued)

(52) U.S. Cl.
CPC ..... *F01L 13/06* (2013.01); *F01L 1/181* (2013.01); *F01L 1/24* (2013.01); *F01L 1/46* (2013.01);
(Continued)

(58) Field of Classification Search
CPC combination set(s) only.
See application file for complete search history.

(56) References Cited

U.S. PATENT DOCUMENTS 6,354,265 B1 3/2002 Hampton et al.
9,790,824 B2 10/2017 Baltrucki et al.
(Continued)

FOREIGN PATENT DOCUMENTS

CN 102477880 A 5/2012
CN 104395563 A 3/2015
(Continued)

OTHER PUBLICATIONS

European Search Report for EP Application No. 18897377 dated Aug. 6, 2021.
(Continued)

*Primary Examiner* — John Kwon
(74) *Attorney, Agent, or Firm* — RMCK Law Group PLC

(57) ABSTRACT

An engine brake rocker arm assembly is operable in an engine drive mode and an engine braking mode and selectively opens first and second exhaust valves. The engine brake rocker arm assembly includes an exhaust rocker arm configured to rotate about a rocker shaft, an engine brake capsule assembly movable between (i) a locked position configured to perform an engine braking operation, and (ii) an unlocked position that does not perform the engine braking operation, and a hydraulically controlled actuator assembly configured to selectively move the engine brake capsule assembly between the first and second positions.

20 Claims, 15 Drawing Sheets

(51) Int. Cl.

| | |
|---|---|
| ***F01L 1/18*** | (2006.01) |
| ***F01L 1/24*** | (2006.01) |
| ***F01L 1/46*** | (2006.01) |
| ***F02D 13/04*** | (2006.01) |
| ***F01L 9/10*** | (2021.01) |

(52) U.S. Cl.
CPC ..... *F01L 9/10* (2021.01); *F02D 13/04* (2013.01); *F01L 2001/467* (2013.01)

(56) References Cited

U.S. PATENT DOCUMENTS

| | | | | |
|---|---|---|---|---|
| 11,022,008 | B2 * | 6/2021 | VanWingerden ..... | F01L 13/065 |
| 2014/0326212 | A1 | 11/2014 | Baltrucki et al. | |
| 2017/0051639 | A1 | 2/2017 | Cecur | |
| 2017/0321576 | A1 | 11/2017 | Nielsen | |
| 2019/0085738 | A1 * | 3/2019 | VanWingerden ..... | F01L 1/267 |
| 2020/0040777 | A1 * | 2/2020 | Nielsen ..... | F01L 1/26 |
| 2020/0182098 | A1 * | 6/2020 | McCarthy, Jr. ..... | F01L 1/24 |
| 2020/0182103 | A1 * | 6/2020 | Mandell ..... | F01L 1/26 |
| 2021/0310425 | A1 * | 10/2021 | Baltrucki ..... | F01L 1/267 |
| 2021/0317760 | A1 * | 10/2021 | Cecur ..... | F01L 1/047 |

FOREIGN PATENT DOCUMENTS

| | | | |
|---|---|---|---|
| CN | 107435567 | A | 12/2017 |
| WO | 2016207348 | A1 | 12/2016 |

OTHER PUBLICATIONS

International Search Report and Written Opinion for International Application No. PCT/US2018/067596 dated Apr. 23, 2019.
First Chinese Office Action for CN Application No. 201880087806.5 dated Dec. 9, 2021.

* cited by examiner

ENGINE BRAKING CASTELLATION MECHANISM

CROSS-REFERENCE TO RELATED APPLICATIONS

This application is a continuation of International Application No. PCT/US2018/067596 filed Dec. 27, 2018, which claims the benefit of Indian Provisional Patent Application No. 201711047278, filed on Dec. 29, 2017, and Indian Provisional Patent Application No. 201811007952, filed on Mar. 3, 2018. The disclosures of the above applications are incorporated herein by reference.

FIELD

The present disclosure relates generally to a rocker arm assembly for use in a valve train assembly and, more particularly, to a rocker arm assembly having an engine brake capsule assembly actuated by a hydraulic actuator assembly.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one example aspect, an engine brake rocker arm assembly operable in an engine drive mode and an engine braking mode is provided. The engine brake rocker arm assembly selectively opens first and second exhaust valves and includes an exhaust rocker arm configured to rotate about a rocker shaft, an engine brake capsule assembly movable between (i) a locked position configured to perform an engine braking operation, and (ii) an unlocked position that does not perform the engine braking operation, and a hydraulically controlled actuator assembly configured to selectively move the engine brake capsule assembly between the first and second positions.

In addition to the foregoing, the described engine brake rocker arm assembly may include one or more of the following features: wherein the engine brake capsule assembly comprises a first castellation member, a second castellation member, and a castellation biasing member that biases the first and second castellation members apart; wherein the first castellation member comprises a series of first teeth and first valleys, and wherein the second castellation member comprises a series of second teeth and second valleys; and wherein the first teeth and second teeth have the same width.

In addition to the foregoing, the described engine brake rocker arm assembly may include one or more of the following features: wherein the first series of teeth oppose the second series of teeth in the locked position during the engine brake mode, and wherein the second series of teeth align with the first valleys in the unlocked position during the engine drive mode; wherein the first castellation member rotates relative to the second castellation member when moving from the unlocked position to the locked position; and wherein the first and second castellation members are configured to collapse toward each other during the unlocked position.

In addition to the foregoing, the described engine brake rocker arm assembly may include one or more of the following features: wherein the engine brake capsule assembly further comprises a third castellation member; wherein the first castellation member comprises a series of third teeth and third valleys, and wherein the third castellation member comprises a series of fourth teeth and fourth valleys; and wherein the third series of teeth oppose the fourth series of teeth in the locked position during the engine brake mode, and wherein the fourth series of teeth align with the third valleys in the unlocked position during the engine drive mode.

In addition to the foregoing, the described engine brake rocker arm assembly may include one or more of the following features: wherein the actuator assembly comprises an actuator pin slidingly disposed within a bore formed in the rocker arm, wherein a hydraulic chamber is defined in the bore between the actuator pin and the rocker arm; wherein the hydraulic chamber is fluidly coupled to a source of hydraulic fluid to selectively move the actuator pin between a first position that corresponds to the engine brake capsule assembly locked position, and a second position that corresponds to the engine brake capsule assembly unlocked position; wherein the actuator assembly further comprises a plug disposed in one end of the bore, and the actuator pin extends at least partially through the plug; wherein the actuator pin includes a first seal, a second seal, and an annular flange, wherein the annular flange is configured to be received within a slot formed in the engine brake capsule assembly, wherein translation of the actuator pin in the bore translates the annular flange to thereby rotate a first castellation member of the engine brake capsule assembly.

In addition to the foregoing, the described engine brake rocker arm assembly may include one or more of the following features: a lost motion spigot assembly at least partially disposed within a bore formed in the rocker arm; wherein the lost motion spigot assembly comprises a guide, a shaft extending through the guide, and a lost motion biasing mechanism seated between the guide and a wall of the rocker arm forming the bore; wherein the lost motion spigot assembly further comprises a nut threadably secured to a first end of the shaft to enable mechanical lash adjustment, and an e-foot operably associated with a second end of the shaft.

In addition to the foregoing, the described engine brake rocker arm assembly may include one or more of the following features: wherein the engine brake capsule assembly is disposed within a bore formed in the rocker arm and comprises a retainer, a lash adjustment screw, a first castellation member, a second castellation member operatively associated with the first castellation member, a castellation shaft extending through the retainer, the lash adjustment screw, and the first and second castellation members, and a castellation biasing mechanism disposed between the first and second castellation members and configured to bias the first and second castellation members apart; and wherein the engine brake capsule assembly further comprises a castellation nut coupled to the lash adjustment screw, and wherein the castellation shaft is configured to slide within the lash adjustment screw.

In one example aspect, a valvetrain assembly is provided. The valvetrain assembly includes a first engine valve, a second engine valve, a valve bridge operatively associated with the first and second engine valves, and an engine brake rocker arm assembly. The engine brake rocker arm assembly includes a rocker arm rotatably coupled to a rocker shaft, a lost motion spigot assembly at least partially disposed within a first bore formed in the rocker arm, the lost motion spigot assembly configured to selectively engage the valve bridge to actuate the first and second engine valves, an engine brake capsule assembly at least partially disposed within a second bore formed in the rocker arm, and movable between (i) a locked position configured to perform an engine braking operation by engaging only the second engine valve, and (ii) an unlocked position that does not perform the engine braking operation, and a hydraulically controlled actuator assembly at least partially disposed within a third bore formed in the rocker arm, and configured to selectively move the engine brake capsule assembly between the first and second positions.

BRIEF DESCRIPTION OF THE DRAWINGS

The present disclosure will become more fully understood from the detailed description and the accompanying drawings, wherein.

DETAILED DESCRIPTION

Heavy duty (HD) diesel engines require high braking power, in particular at low engine speed. Some HD diesel engines are configured with valvetrains having a valve bridge and include with single overhead cam (SOHC) and overhead valve (OHV) valvetrain. The present disclosure provides high braking power without applying high load on the rest of the valvetrain (particularly the pushrod and camshaft). In this regard, the present disclosure provides a configuration that opens only one exhaust valve during a braking event.

Figure 1:
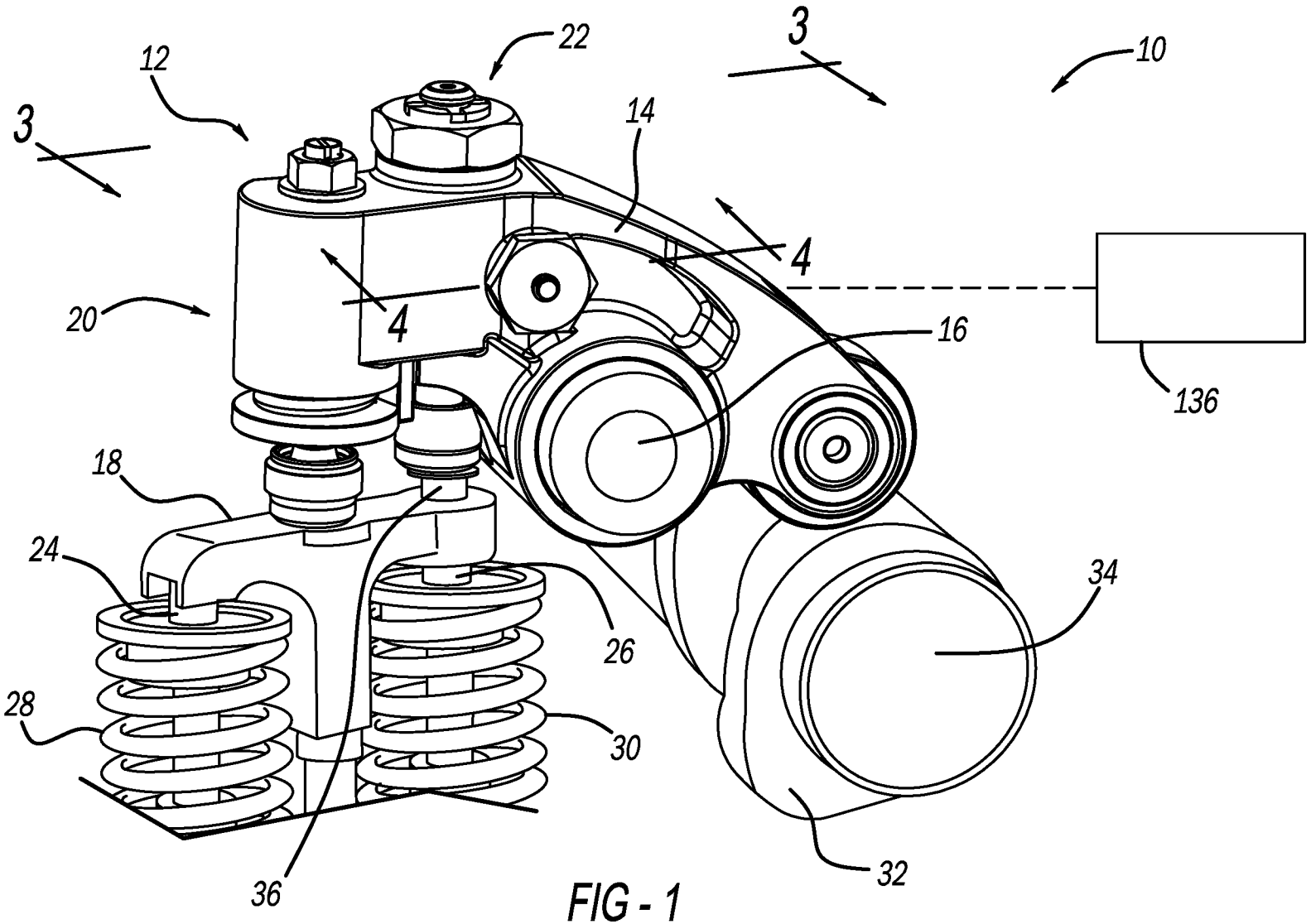
FIG. 1 is a perspective view of a partial valve train assembly including an exhaust rocker arm constructed in accordance to one example of the present disclosure and shown cooperating with a valve bridge and first and second exhaust valves.

With initial reference to FIG. 1, a partial valvetrain assembly constructed in accordance to one example of the present disclosure is shown and generally identified at reference 10. The partial valve train assembly 10 utilizes engine braking and is shown configured for use in a six-cylinder engine. It will be appreciated however that the present teachings are not so limited. In this regard, the present disclosure may be used in any valve train assembly that utilizes engine braking.

The partial valve train assembly 10 is supported in a valve train carrier (not specifically shown) and can include two rocker arms per cylinder. In the example embodiment, each cylinder includes an intake valve rocker arm assembly (not shown) and an exhaust valve rocker arm assembly 12. The intake valve rocker arm assembly is configured to control motion of intake valves of an associated engine (not shown).

In the example embodiment, the exhaust valve rocker arm assembly 12 incorporates integrated engine brake functionality and is configured to control opening of exhaust valves of the engine. In general, the exhaust valve rocker arm assembly 12 is configured to control exhaust valve motion in a combustion engine drive mode and an engine brake mode, as will be described herein in more detail. Moreover, the exhaust valve rocker arm assembly 12 is configured to act on one of the two exhaust valves during the brake mode.

Figure 2:
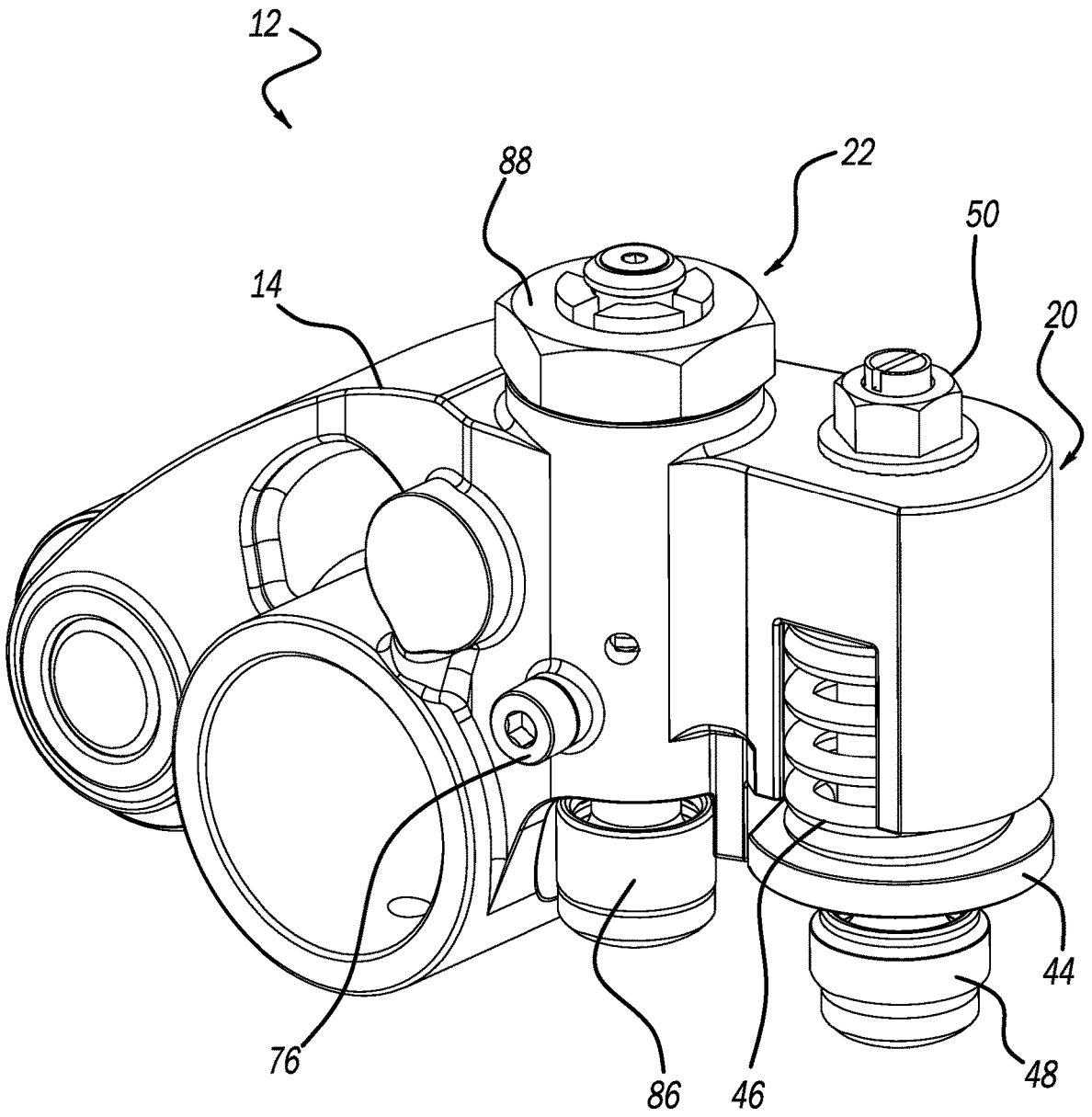
FIG. 2 is another perspective view of the example exhaust rocker arm shown in FIG. 1.

With additional reference to FIGS. 2 and 3, exhaust valve rocker arm assembly 12 will be described in more detail. In one example, the exhaust valve rocker arm assembly 12 can generally include an exhaust rocker arm 14 that rotates about a rocker shaft 16, a valve bridge 18, a lost motion spigot assembly 20, and an engine brake capsule assembly 22.

In the example embodiment, the valve bridge 18 is configured to engage first and second exhaust valves 24, 26 associated with a cylinder of the engine. In the illustrated example, the first exhaust valve 24 is a non-braking exhaust valve that is biased by a valve spring 28, and the second exhaust valve 26 is a braking exhaust valve that is biased by a valve spring 30. The exhaust rocker arm 14 rotates around the rocker shaft 16 based on a lift profile 32 of a cam shaft 34, as described herein in more detail, and a pass through pin 36 is positioned on the valve bridge 18 to enable actuation of exhaust valve 26 without actuation of valve bridge 18 or first exhaust valve 24.

Figure 3:
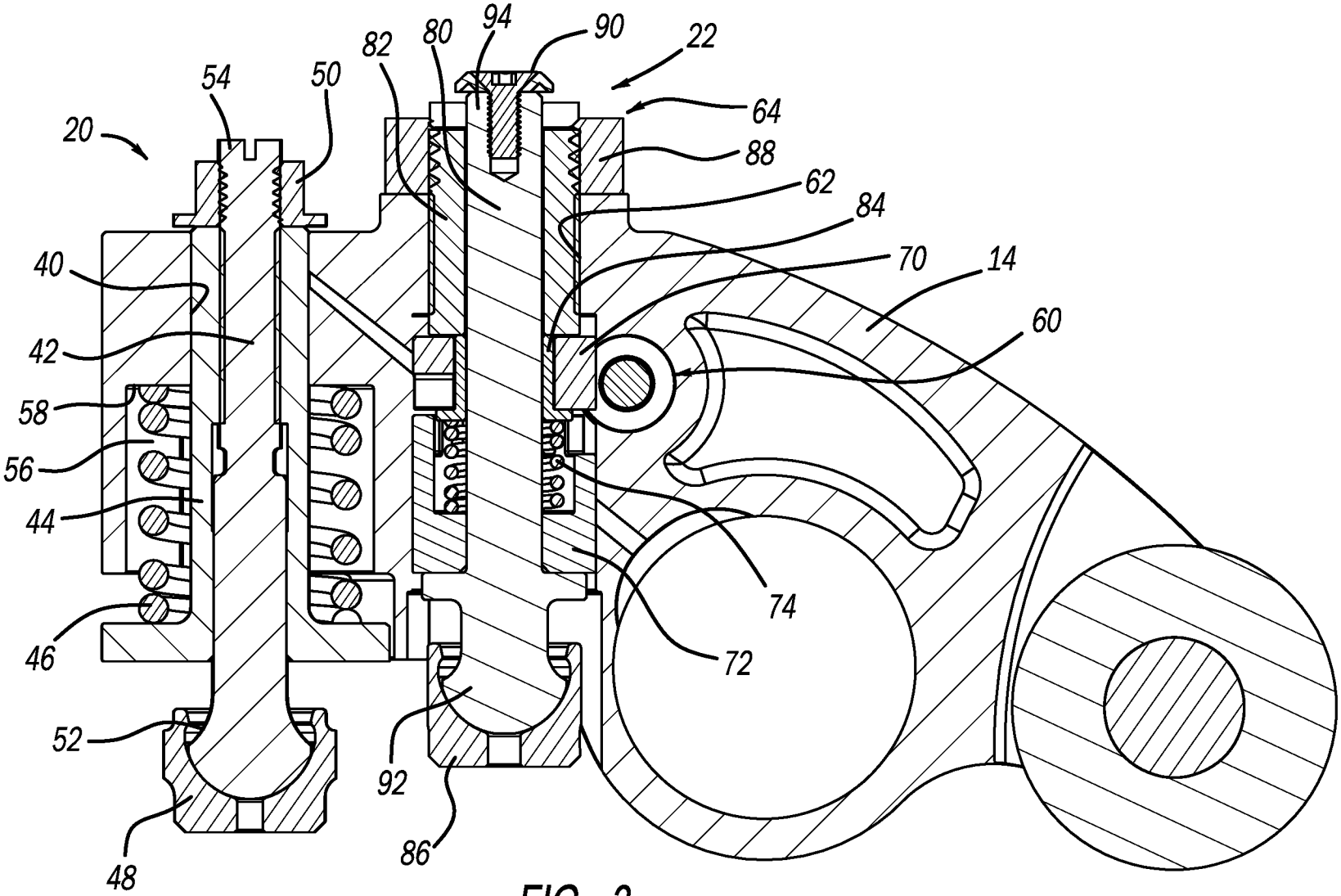
FIG. 3 is a cross-sectional view of the exhaust rocker arm shown in FIG. 1 and taken along line 3-3.

With reference to FIG. 3, in the example embodiment, the lost motion spigot assembly 20 is disposed within a bore 40 formed in the rocker arm 14 and generally includes a shaft 42, a guide 44, a lost motion biasing mechanism 46 (e.g., a spring), an e-foot 48, and a nut 50. The shaft 42 includes a first end 52 and an opposite second end 54 and extends through the guide 44, which is disposed within the bore 40. The lost motion biasing mechanism 46 is disposed within a cavity 56 and is seated between the guide 44 and a wall 58 partially defining the rocker arm bore 40. The e-foot 48 is coupled to or operably associated with the shaft first end 52, and the nut 50 is threadably secured to the shaft second end 54. The valve lash set at a central contact point of the bridge 18 may be adjusted by way of shaft 42 and nut 50. In this regard, the nut 50 can be adjusted (e.g., rotated) to provide a desired lost motion stroke (LMS). Other configurations may be used.

Figure 4A:
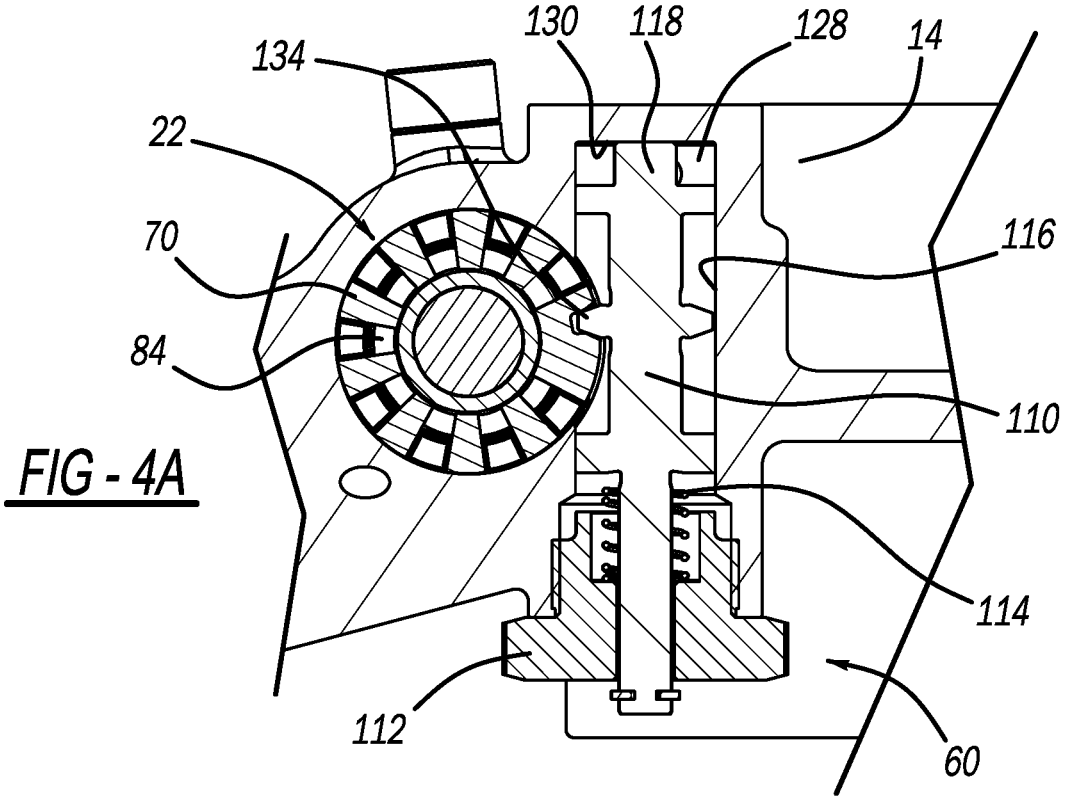
FIG. 4A is a cross-sectional view of a portion of the exhaust rocker arm shown in FIG. 1, taken along line 4-4, and showing an example actuator assembly in a first position.
Figure 4B:
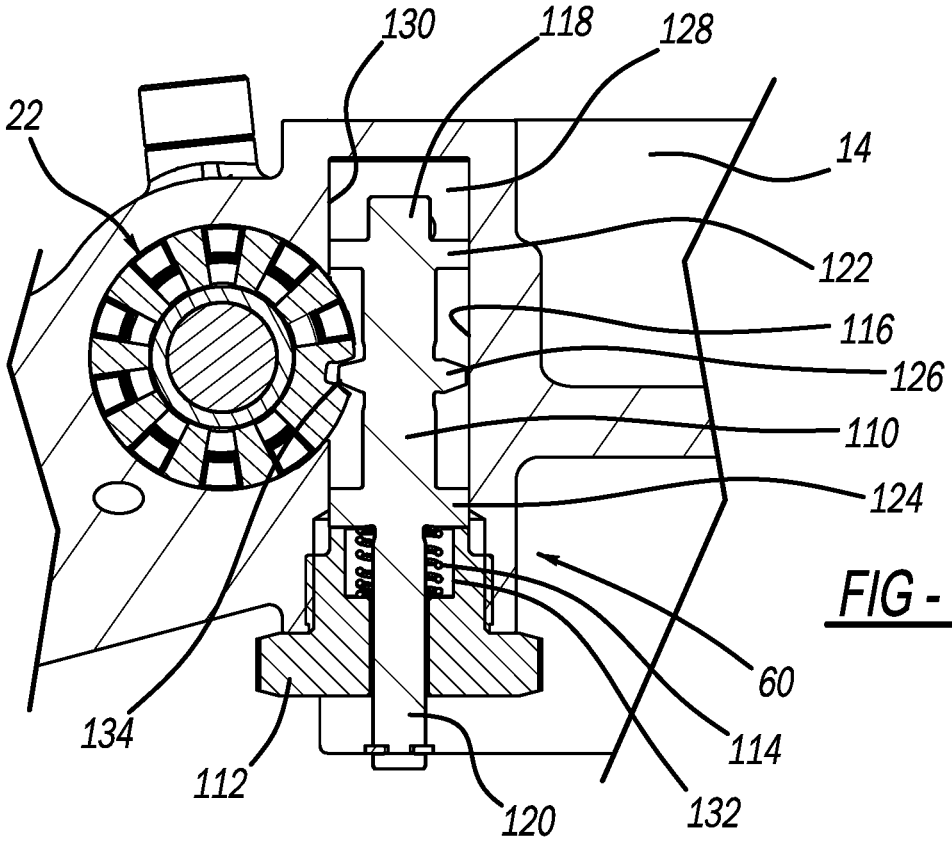
FIG. 4B is a cross-sectional view of the example actuator assembly shown in FIG. 4A in a second position.

With continued reference to FIGS. 3 and 4, in the example embodiment, the engine brake capsule assembly 22 is operably associated with an actuator assembly 60. As will become appreciated from the following discussion, the actuator assembly 60 is hydraulically controlled between a first position (FIG. 4A) and a second position (FIG. 4B) to mechanically move the engine brake capsule assembly 22 between a respective latched or locked position (e.g., FIG. 10B) and an unlatched or unlocked position (e.g., FIG. 7B). Notably, the actuator assembly 60 fluidly segregates the engine brake capsule 22 from a source of hydraulic fluid. The intermediate placement of the hydraulic actuator assembly 60 between the selectively lockable engine brake capsule assembly 22 and the source of hydraulic fluid eliminates limitations associated with a fully mechanical actuator.

With further reference to FIG. 3, in the illustrated example, the engine brake capsule assembly 22 is at least partially disposed within a bore 62 formed in the rocker arm 14 and generally includes a mechanical lash adjuster assembly 64, a first castellation member 70, a second castellation member 72, and a castellation biasing member 74. An anti-rotation mechanism 76 (FIG. 2) such as a screw extends at least partially through the rocker arm 14 and is configured to facilitate preventing rotation of the engine brake capsule assembly 22 within the bore 62.

The mechanical lash adjuster assembly 64 generally includes a castellation shaft 80, a lash adjustment screw 82, a retainer 84, an e-foot 86, a castellation nut 88, and a stop screw and washer 90. The castellation shaft 80 includes a first end 92 and an opposite second end 94 and extends through the lash adjustment screw 82 and the retainer 84, which are disposed at least partially within the rocker arm bore 62. Moreover, the castellation shaft 80 can be configured to slide within lash adjustment screw 82. The e-foot 86 is coupled to or operably associated with the castellation shaft first end 92, and stop screw and washer 90 can be threadably secured to an inner bore formed in the castellation shaft second end 94. The castellation nut 88 is threadably secured to the lash adjustment screw 82. The valve lash set at a contact point of the bridge 18 may be adjusted by way of lash adjustment screw 82 and castellation nut 88.

Figure 6A:
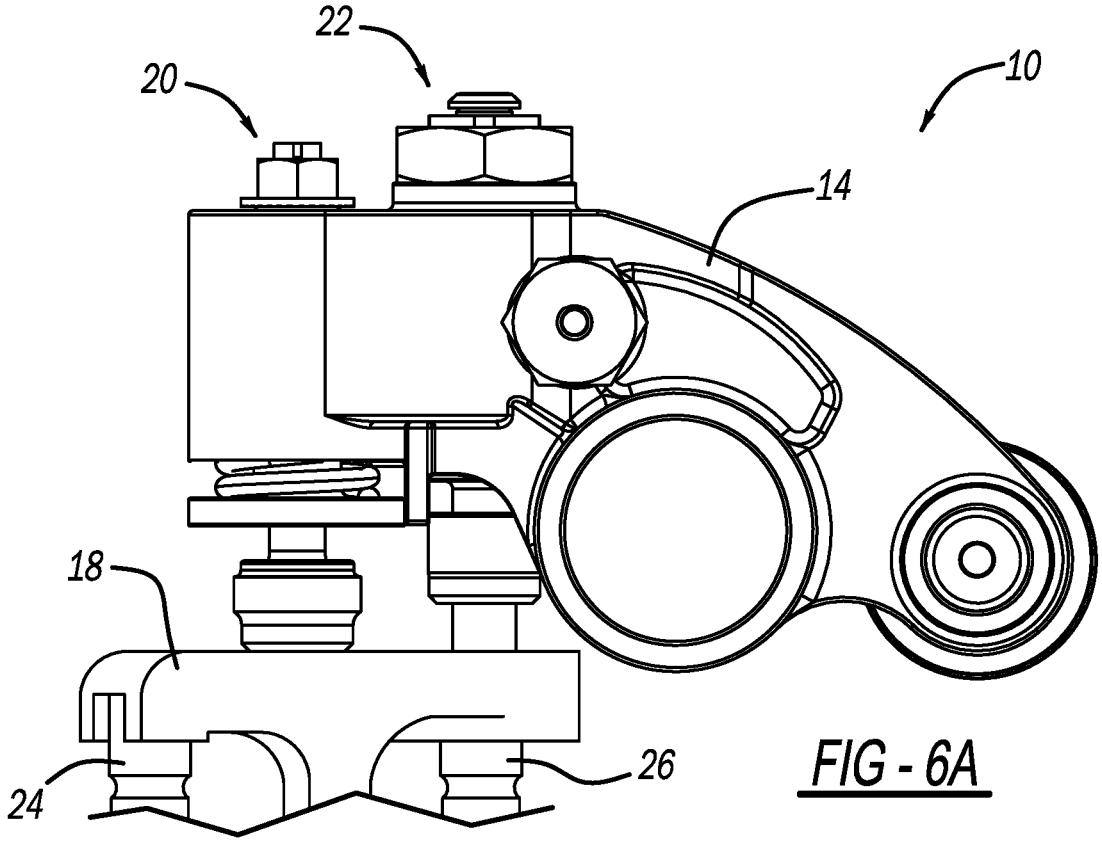
FIG. 6A is a perspective view of the exhaust rocker arm shown in FIG. 1 in a first position during a drive mode operation.
Figure 6B:
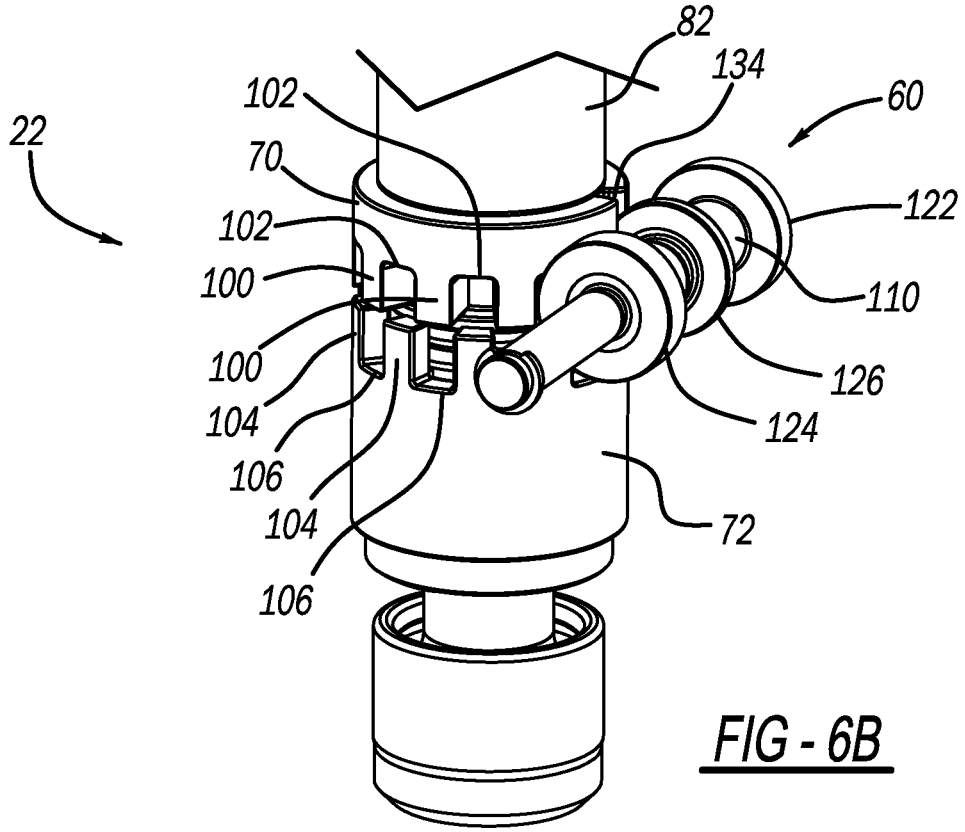
FIG. 6B is a perspective view of an example engine brake capsule assembly of the exhaust rocker arm shown in FIG. 6A.

In the example embodiment, the first castellation member 70 can be a cup-like castellated capsule body having a series of first teeth 100 and first valleys 102, and the second castellation member 72 can be a cup-like castellated capsule body having a series of second teeth 104 and second valleys 106 (see FIG. 6B for example). As described herein in more detail, the castellation members 70, 72 can be positioned in the locked position (FIG. 10B) where the first and second teeth 100, 104 engage each other, or in the unlocked position (FIG. 7B) where the first and second teeth 100, 104 are respectively received within the second and first valleys 106, 102.

As shown in FIG. 3, in the example embodiment, the first castellation member 70 is seated on the retainer 84 between the lash adjustment screw 82 and the retainer 84, and the second castellation member 72 is seated on the castellation shaft 80 between the first castellation member 70 and the castellation shaft 80. The castellation biasing member 74 can be disposed between the second castellation member 72 and the first castellation member 70 (or the retainer 84, which engages the first castellation member 70) and is configured to bias the first and second castellation members 70, 72 apart from each other.

With additional reference to FIGS. 4A and 4B, the actuator assembly 60 will be described in more detail. The actuator assembly 60 is configured to rotate the first castellation member 70 relative to the second castellation member 72 to switch the engine brake capsule assembly 22 between the brake active, locked position (FIG. 10B) and the brake inactive, unlocked position (FIG. 7B). In the example embodiment, the actuator assembly 60 generally includes an actuator pin 110, a retainer or plug 112, and a pin return mechanism 114 (e.g., a spring). While the actuator pin 110 is described herein as hydraulically actuated, it will be appreciated that actuator pin 110 may be actuated by other means such as, for example, electric, pneumatic, and/or electromagnetic.

The actuator pin 110 is configured to translate within a bore 116 formed in the rocker arm 14 and generally includes a first end 118, an opposite second end 120, a first seal 122, a second seal 124, and an annular flange 126. The first end 118 includes the first seal 122 and defines a hydraulic chamber 128 between the actuator pin 110 and a rocker arm inner wall 130 that defines a portion of the bore 116. The hydraulic chamber 128 can be fluidly coupled to a source of hydraulic fluid, for example, via a fluid port formed in the rocker arm 14 (not shown). The second end 120 is received within plug 112 and includes the second seal 124. The pin return mechanism 114 is disposed at least partially within a seat 132 formed in the plug 112 and is configured to bias the actuator pin 110 toward the inner wall 130 into the unlocked position (FIG. 4A).

In the example embodiment, the annular flange 126 is received within a slot 134 formed in the first castellation member 70. However, it will be appreciated that in alternative arrangements, the annular flange 126 can be received within a slot formed in the second castellation member 72. In the example shown, the actuator pin 110 can actuate as a result of high pressure fluid entering the hydraulic chamber 128 behind the actuator pin 110, thereby translating actuator pin 110 within bore 116. This causes rotational movement of the first castellation member 70, as described herein in more detail. The fluid can be pressurized engine oil or other hydraulic fluid.

As discussed, the engine brake capsule assembly 22 is movable between the brake inactive (unlocked) position and the brake active (locked) position by the actuator assembly 60. In the unlocked, brake inactive position (FIG. 7B), the second teeth 104 of second castellation member 72 are aligned with the first valleys 102 of the first castellation member 70, and the first teeth 100 of the first castellation member 70 are aligned with the second valleys 106 of the second castellation member 72 such that the second castellation member 72 slides inside the first castellation member 70 and the engine brake capsule assembly 22 collapses. In the locked, brake active position (FIG. 10B), the actuator assembly 60 rotates the first castellation member 70 relative to the second castellation member 72 so the first and second teeth 100, 104 are aligned such that the second castellation member 72 is locked with the first castellation member 70 and engine braking is activated.

Figure 5A:
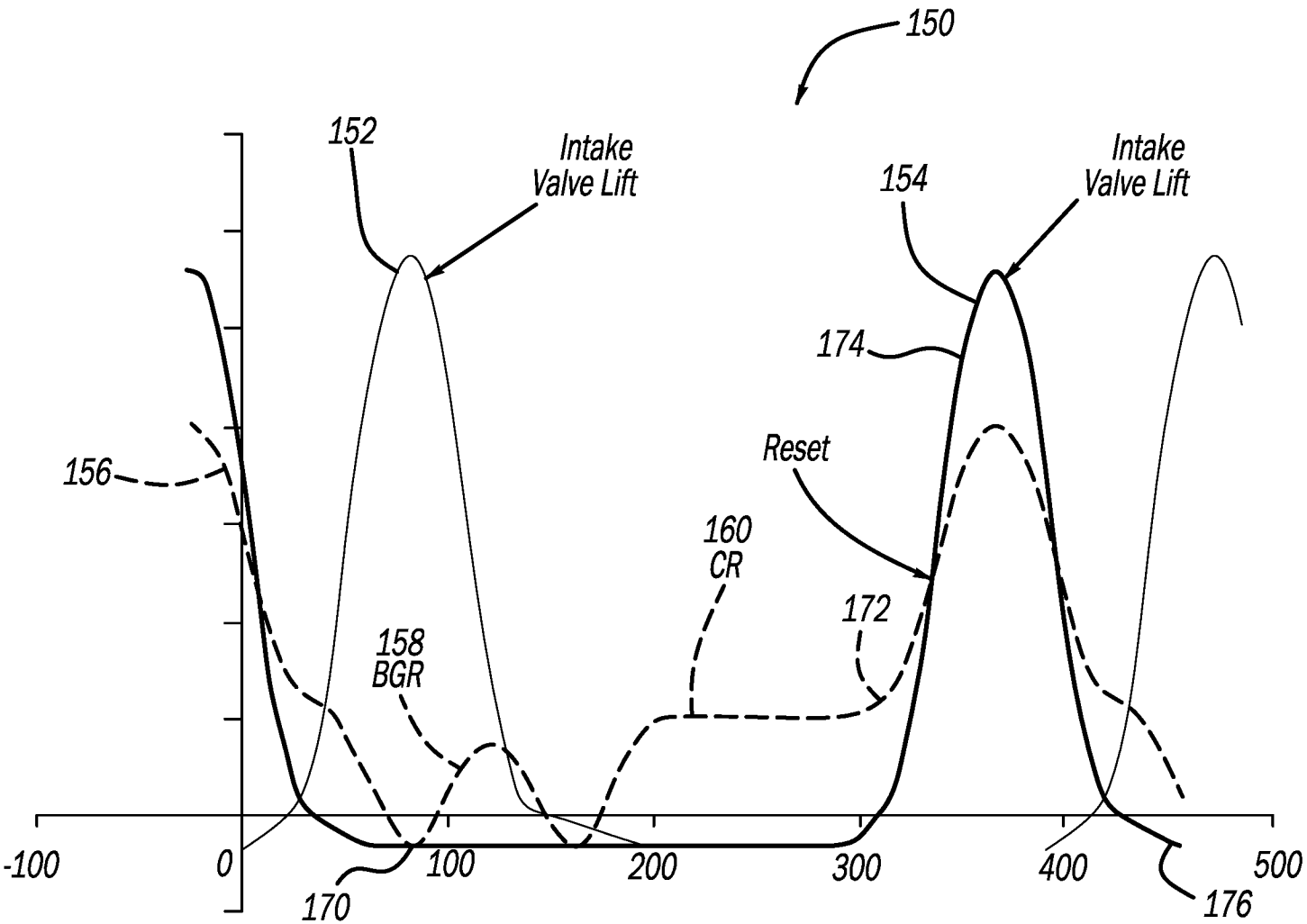
FIG. 5A is a plot illustrating an example valve lift of the valve assembly shown in FIG. 1 operating in an example drive mode, according to the present disclosure.
Figure 5B:
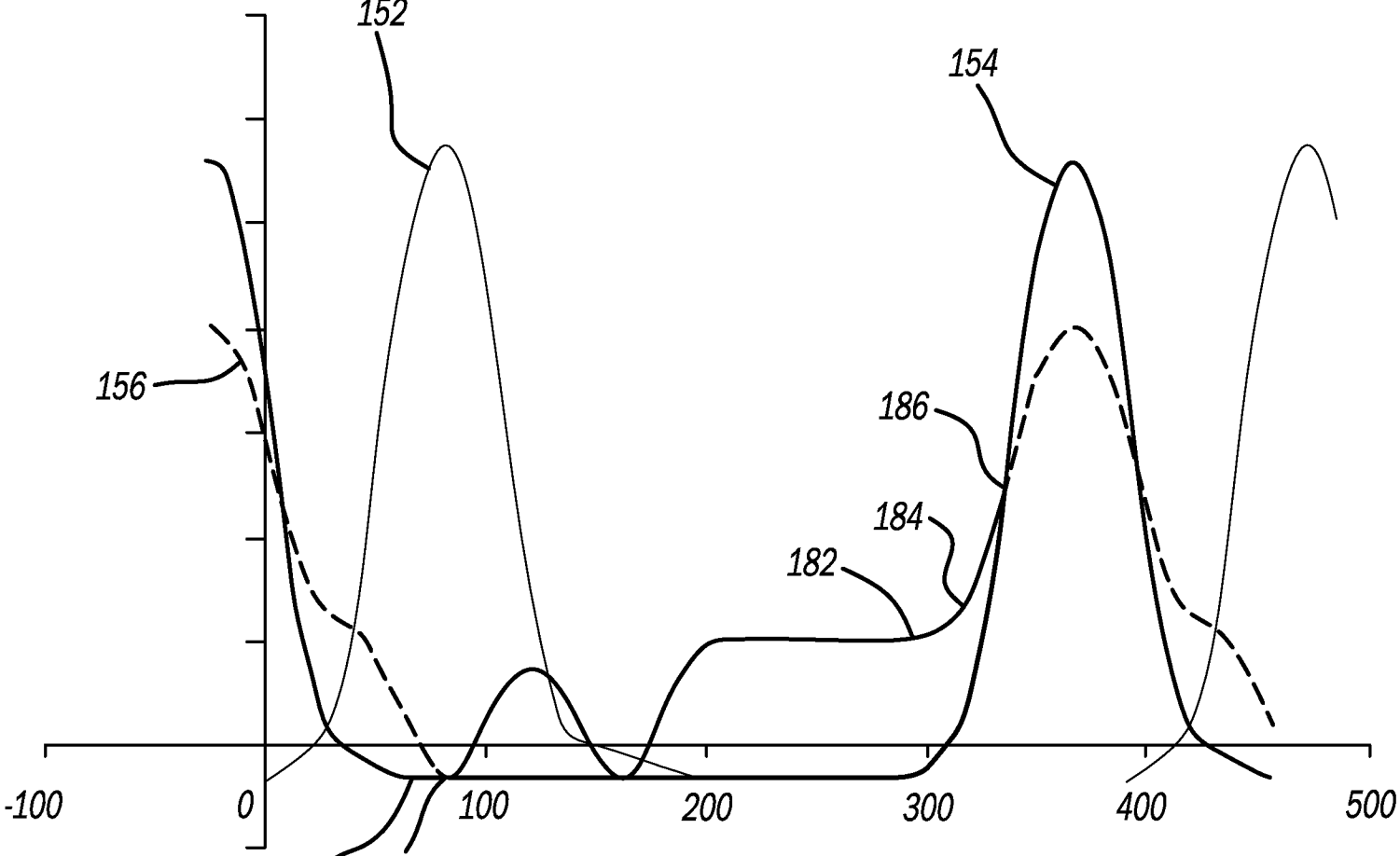
FIG. 5B is a plot illustrating an example valve lift of the valve assembly shown in FIG. 1 operating in an example brake mode, according to the present disclosure.

Turning now to FIG. 5A, a plot 150 is shown illustrating an example operation of valvetrain assembly 10 in the drive mode, and FIG. 5B illustrates a plot 168 illustrating an example operation of valvetrain assembly 10 in the brake mode. FIGS. 5A and 5B illustrate an intake valve lift 152, an exhaust valve lift 154 of the exhaust valves 24, 26, an engine brake exhaust valve lift 156 of one exhaust valve 26, engine brake exhaust lift with brake gas recirculation (BGR) 158, and compression release (CR) 160. Opening only one exhaust valves 26 instead of both of the exhaust valves 24, 26 during engine braking operating mode allows the engine brake exhaust valve 24 or 26 to open later in the compression stroke and in that way offer higher braking power.

Figure 7A:
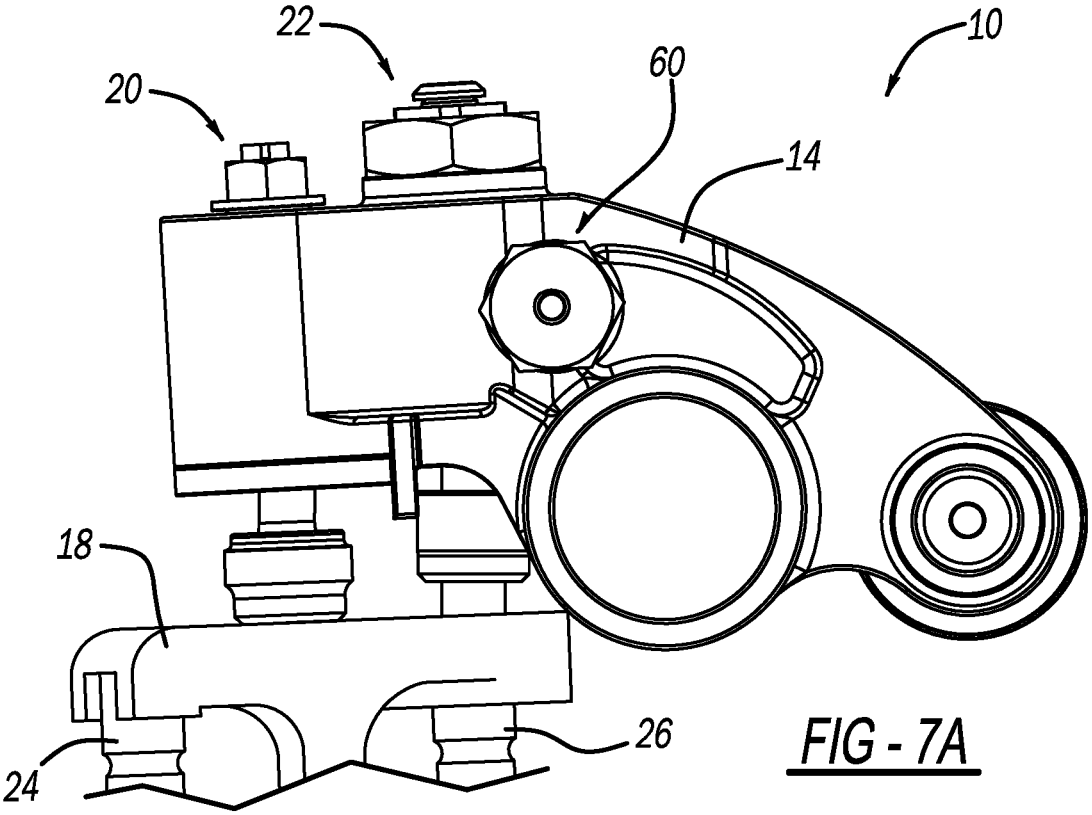
FIG. 7A is a perspective view of the exhaust rocker arm shown in FIG. 6A in a second position during the drive mode operation.
Figure 7B:
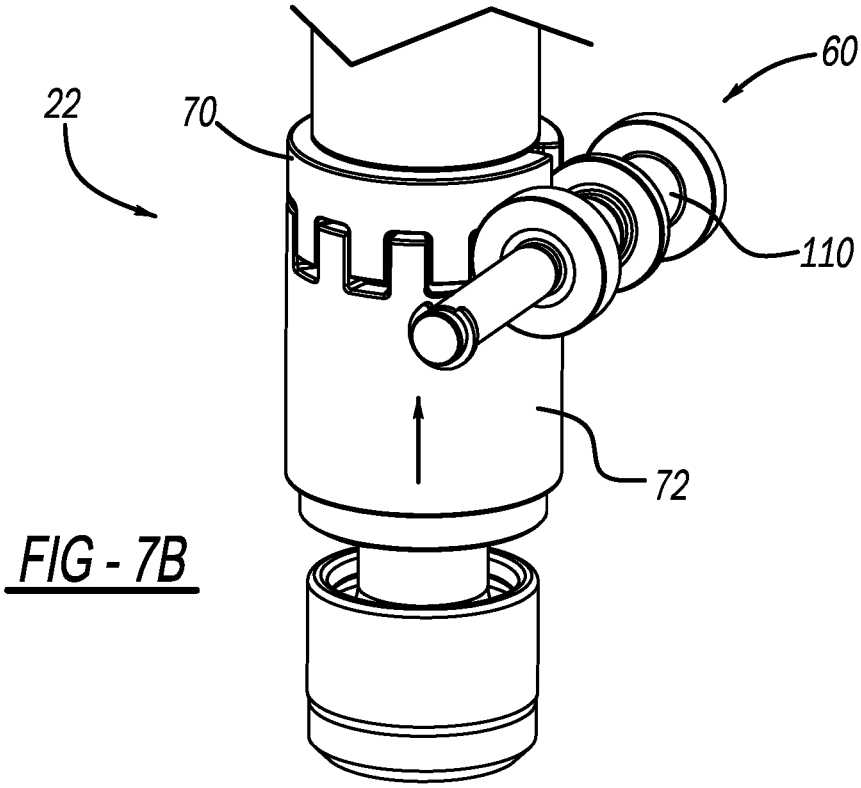
FIG. 7B is a perspective view of a position of the example engine brake capsule assembly when the exhaust rocker arm is shown as positioned in FIG. 7A.
Figure 8A:
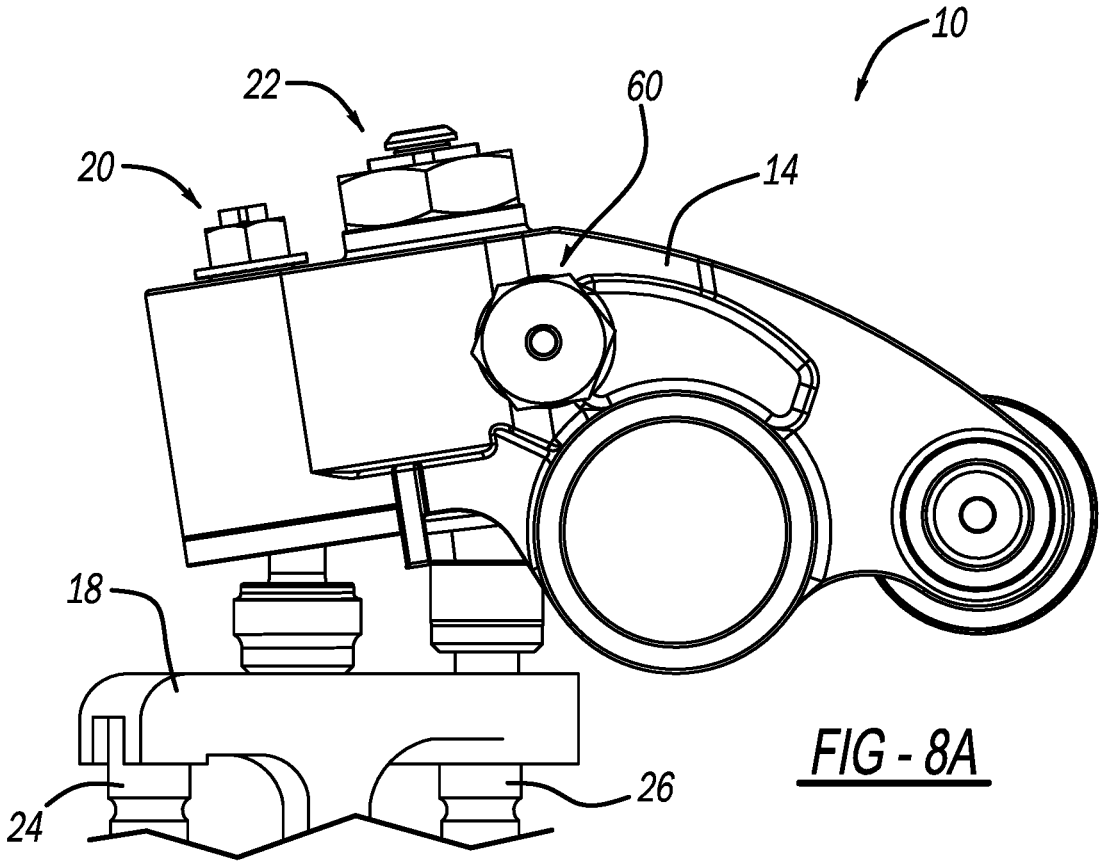
FIG. 8A is a perspective view of the exhaust rocker arm shown in FIG. 6A in a third position during the drive mode operation.

With reference to FIGS. 5-12, an example method of operating the valve train assembly 10 is described in more detail. FIGS. 6-8 illustrate the valve train assembly 10 operated in a normal drive mode by a controller 136 (FIG. 1), and FIGS. 9-12 illustrate the valve train assembly 10 operated in an engine brake mode by controller 136. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

When the engine is in the drive (combustion) mode (FIGS. 6-8), operation begins when the base circle of cam lift profile 32 engages the rocker arm 14, shown in FIG. 6 and represented as point 170 (FIG. 5A). In this position, controller 136 supplies low pressure fluid (e.g., oil) to the hydraulic chamber 128. This low pressure fluid does not have enough pressure to overcome the pin return mechanism 114 and move actuator pin 110. As such, the actuator pin 110 is biased by pin return mechanism 114 into a default position (FIG. 4A), which corresponds to the brake inactive position of engine brake capsule assembly 22 (shown in FIG. 6B). Thus, when motion of the cam lift profile 32 causes rotation of the exhaust rocker arm 14 at point 172 (FIG. 5A), the brake capsule assembly 22 collapses and does not transfer motion to the exhaust valve 26 (shown in FIG. 7B). Moreover, at the same time, motion of the spigot assembly 20 is absorbed by lost motion biasing mechanism 46 such that motion is not transferred to the valve bridge 18 or exhaust valves 24, 26.

Figure 8B:
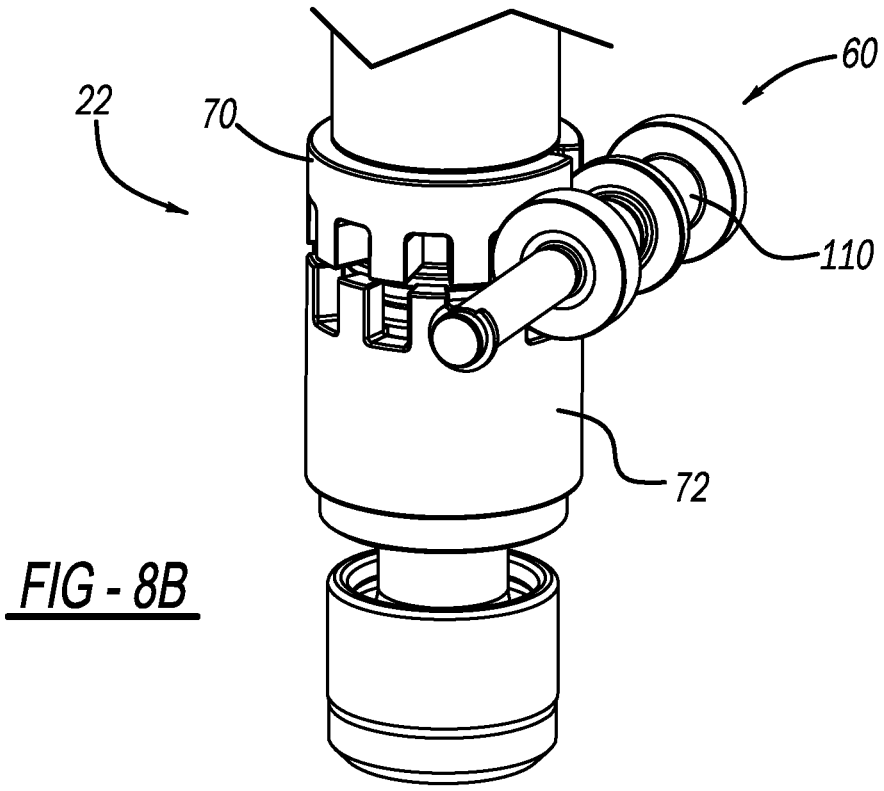
FIG. 8B is a perspective view of a position of the example engine brake capsule assembly when the exhaust rocker arm is shown as positioned in FIG. 8A.

At point 174 (FIG. 5A), the cam lift profile 32 rotates exhaust rocker arm 14 even farther to where lost motion biasing mechanism 46 no longer absorbs rocker arm motion (see FIG. 8), thereby causing downward movement of valve bridge 18 and opening of exhaust valves 24, 26 during the standard time (exhaust stroke) while the engine brake capsule assembly 22 regains a nominal position (FIG. 8B). At point 176, the cam lift profile 32 returns to the base circle and exhaust valves 24, 26 close at the standard time (end of exhaust stroke).

Figure 9A:
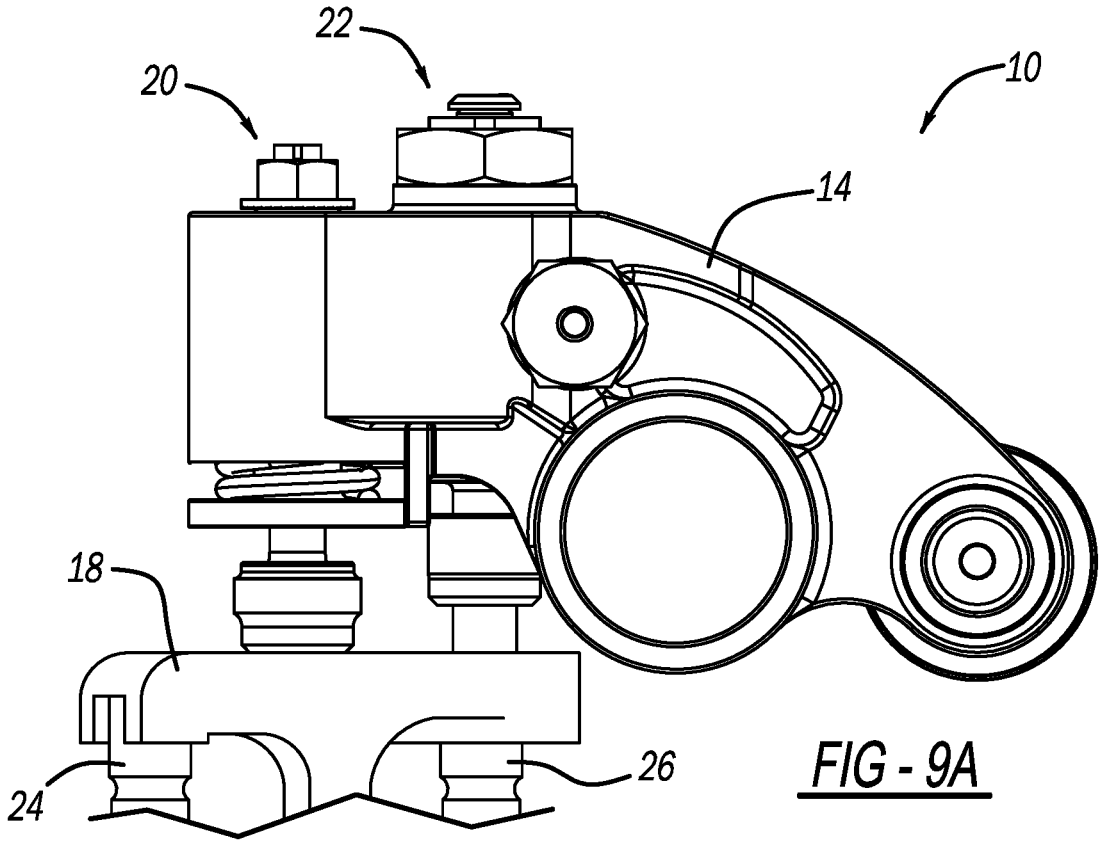
FIG. 9A is a perspective view of the exhaust rocker arm shown in FIG. 1 in a first position during a brake mode operation.
Figure 9B:
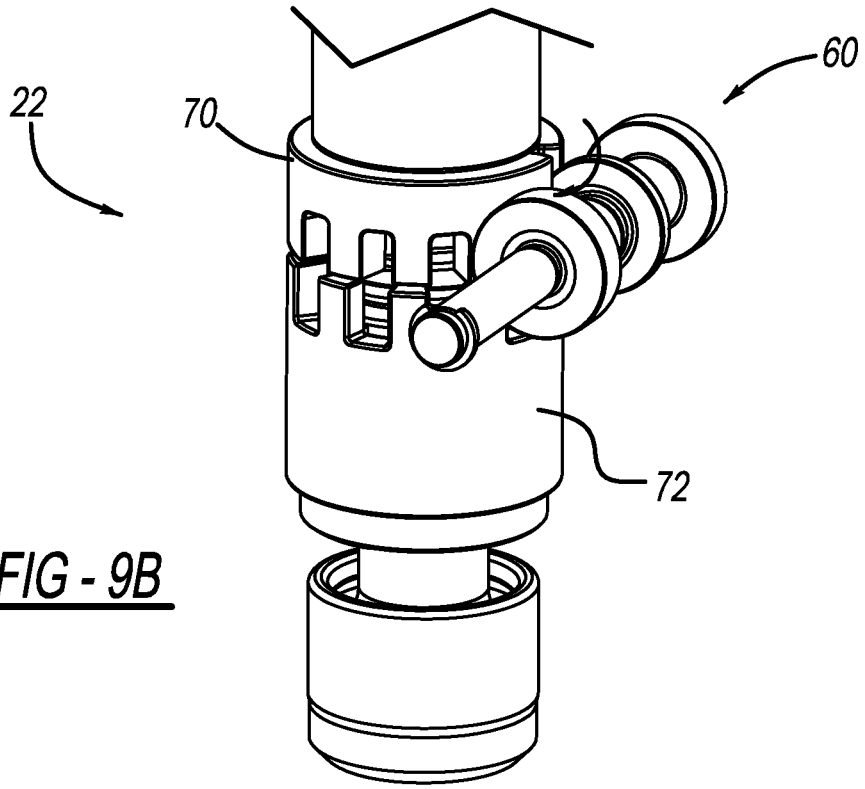
FIG. 9B is a perspective view of an example engine brake capsule assembly of the exhaust rocker arm shown in FIG. 9A.

In braking mode (FIGS. 9-12), operation begins when the base circle of cam lift profile 32 engages the rocker arm 14, shown in FIG. 9 and represented as point 180 (FIG. 5B). In this position, controller 136 supplies high pressure fluid to the hydraulic chamber 128. The high pressure fluid acts on the actuator pin 110 and overcomes the biasing force of pin biasing mechanism 114. As such, the high pressure fluid translates actuator pin 110 within bore 116 to the position shown in FIG. 4B, which causes subsequent rotational movement of the first castellation member 70 relative to the second castellation member 72, thereby transitioning brake capsule assembly 22 from the unlocked, brake inactive position to the locked, brake active position shown in FIG. 9B.

Figure 10A:
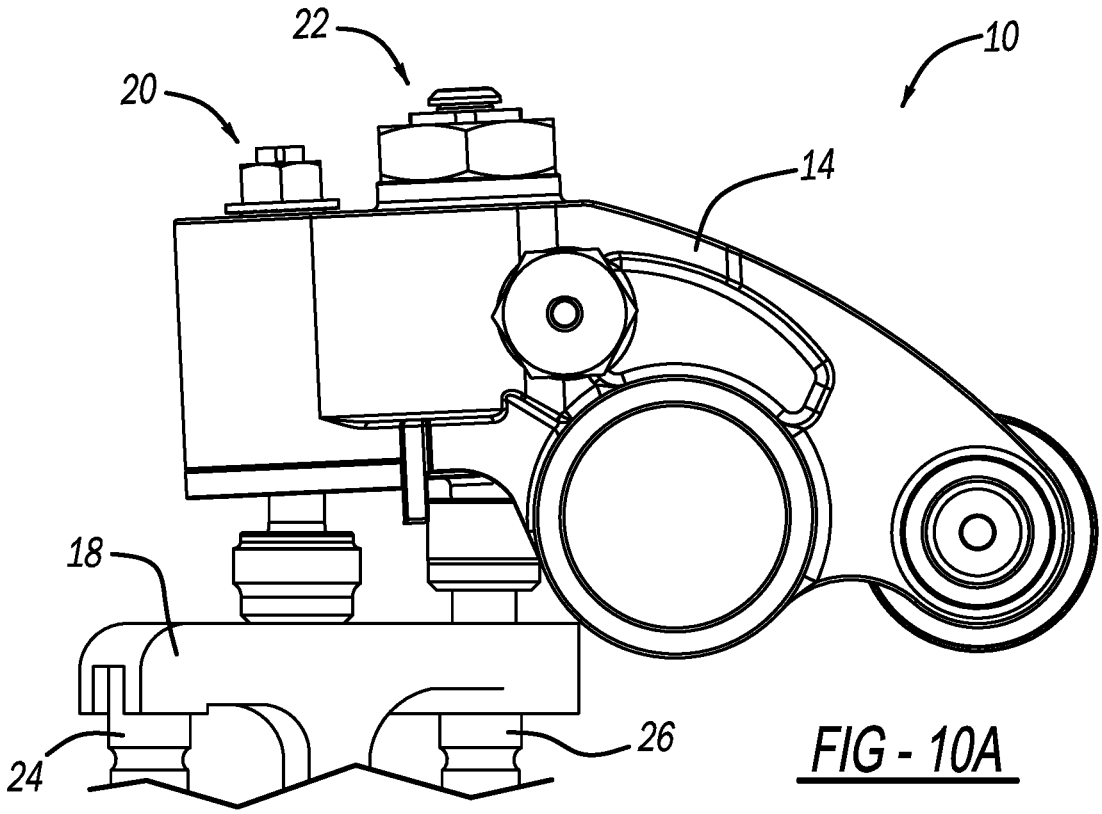
FIG. 10A is a perspective view of the exhaust rocker arm shown in FIG. 9A in a second position during the brake mode operation.
Figure 10B:
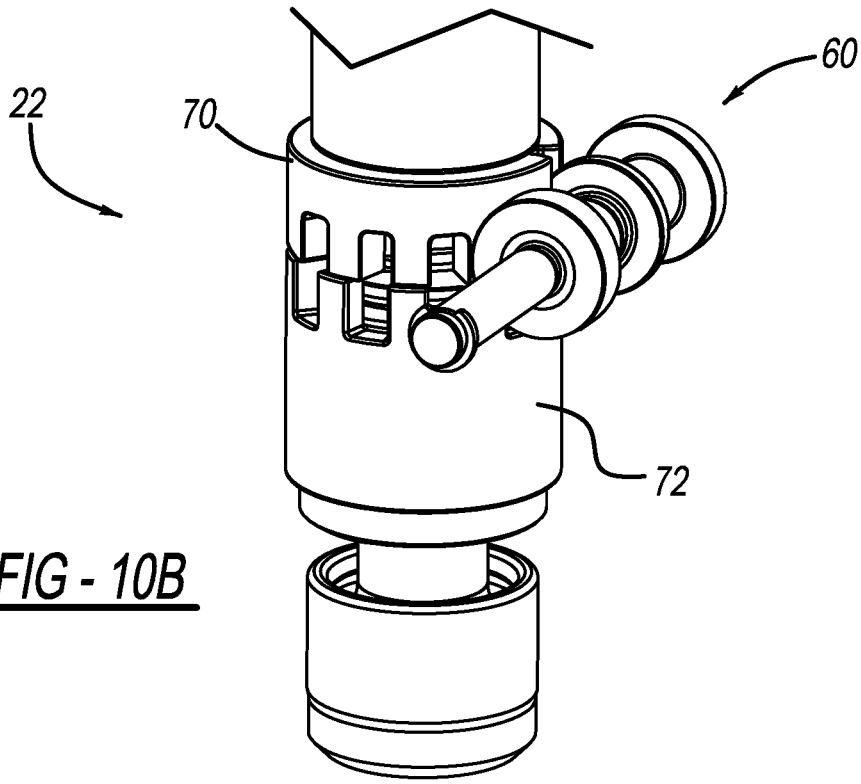
FIG. 10B is a perspective view of a position of the example engine brake capsule assembly when the exhaust rocker arm is shown as positioned in FIG. 10A.
Figure 11A:
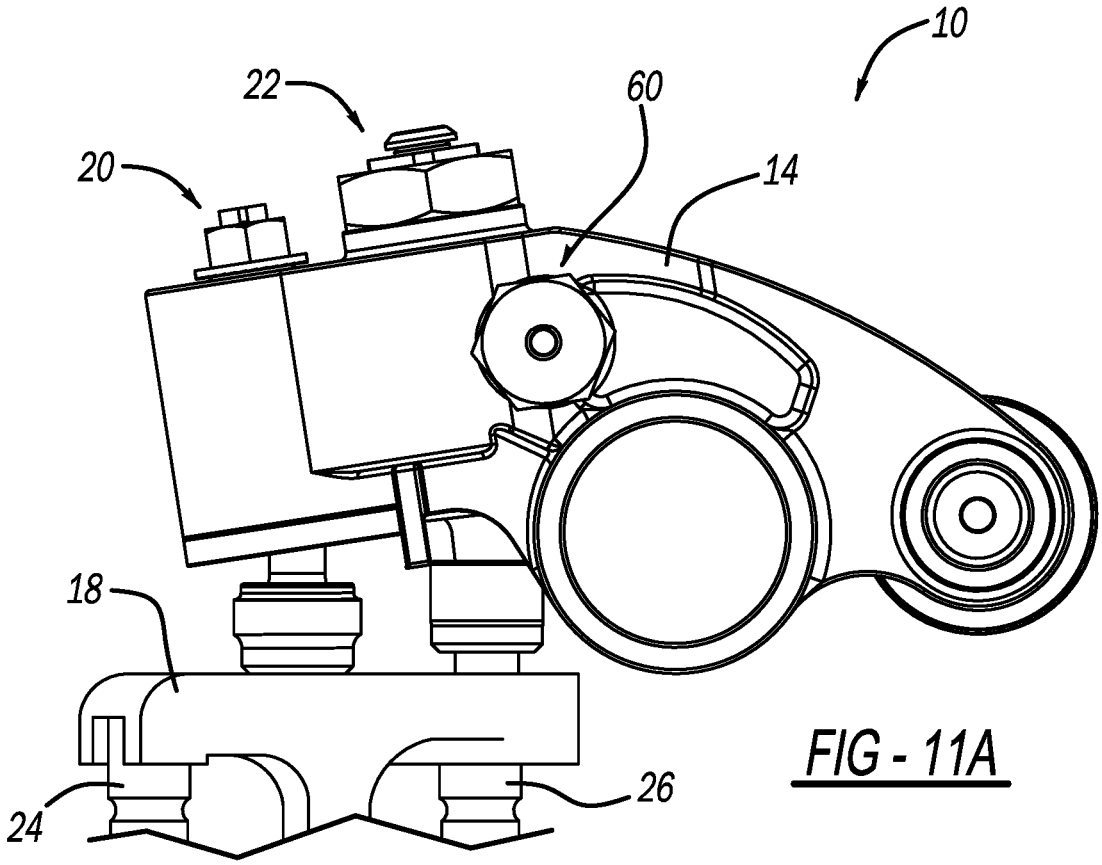
FIG. 11A is a perspective view of the exhaust rocker arm shown in FIG. 9A in a third position during the brake mode operation.
Figure 11B:
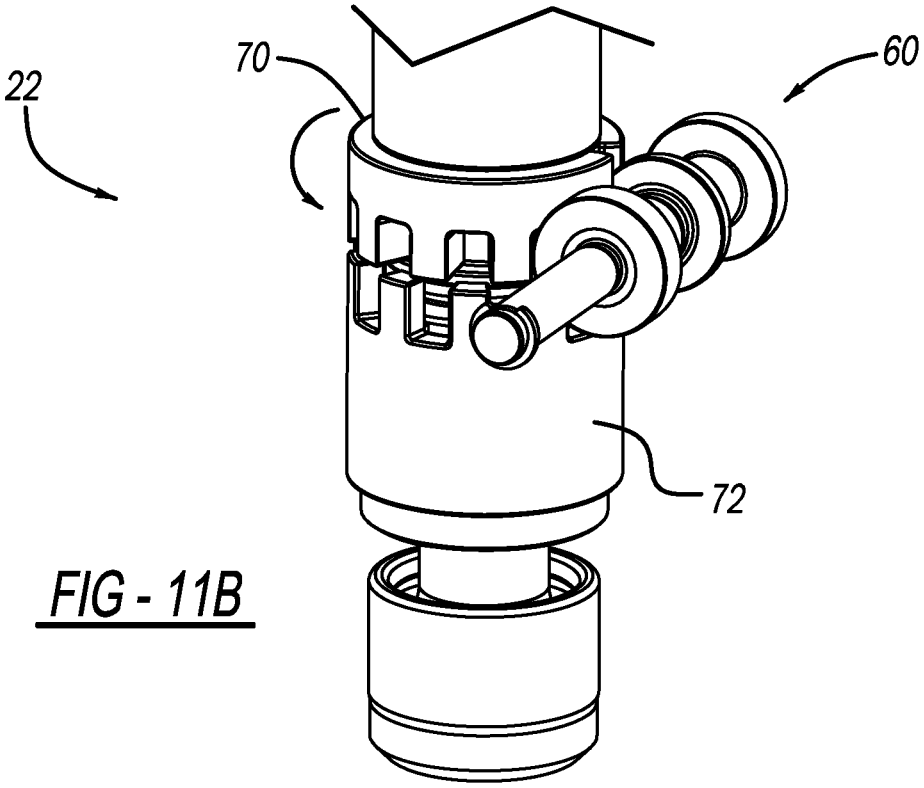
FIG. 11B is a perspective view of a position of the example engine brake capsule assembly when the exhaust rocker arm is shown as positioned in FIG. 11A.
Figure 12A:
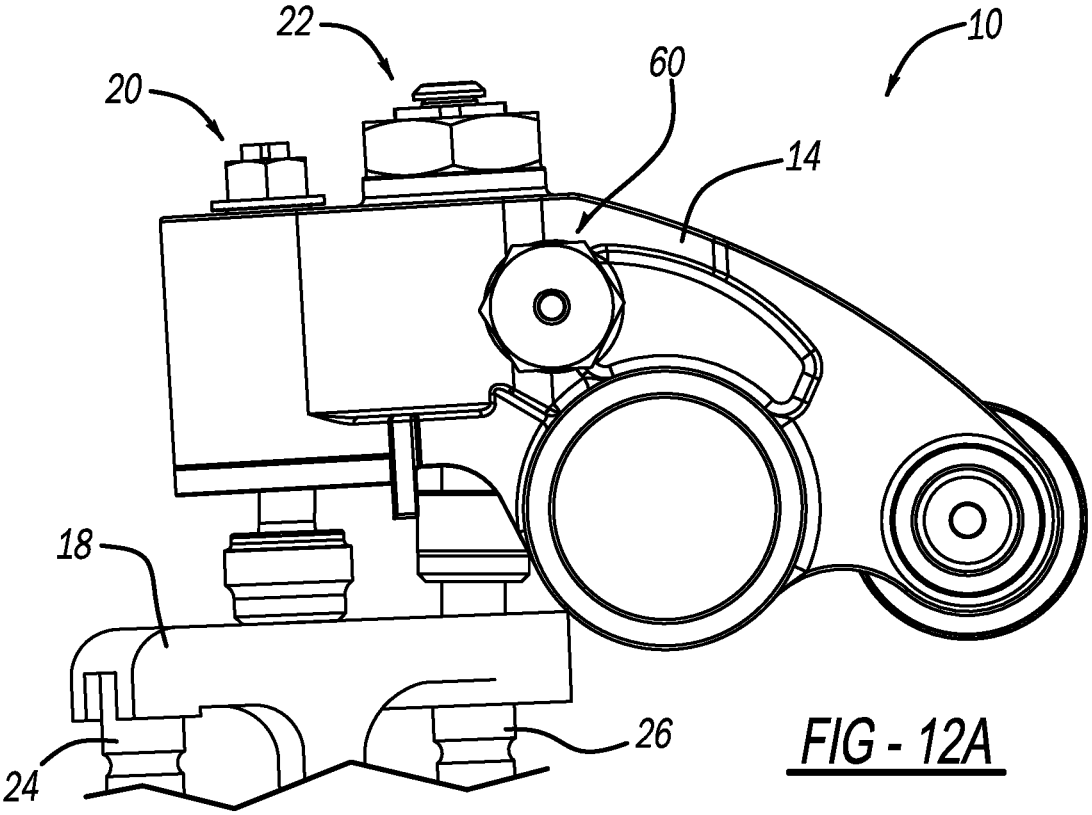
FIG. 12A is a perspective view of the exhaust rocker arm shown in FIG. 9A in a fourth position during the brake mode operation.
Figure 12B:
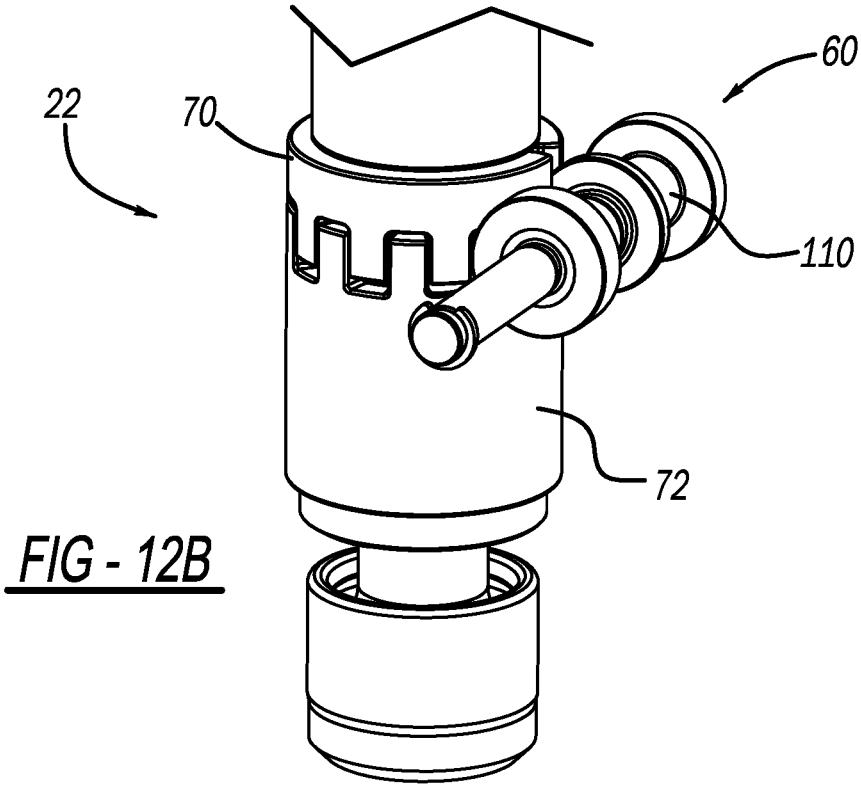
FIG. 12B is a perspective view of a position of the example engine brake capsule assembly when the exhaust rocker arm is shown as positioned in FIG. 12A.

Accordingly, when motion of the cam lift profile 32 causes rotation of the exhaust rocker arm 14 at point 182 (FIG. 5B), the locked engine brake capsule assembly 22 transfers motion to the exhaust valve 26 downward movement of exhaust rocker arm 14 transfers motion from brake capsule assembly 22 to exhaust valve 26 (see FIG. 10). At this same time, spigot assembly 20 operates in lost motion such that motion is not transferred to the valve bridge 18 or exhaust valve 24.

At point 184 (FIG. 5B), the cam lift profile 32 rotates exhaust rocker arm 14 even farther to where lost motion biasing mechanism 46 no longer absorbs rocker arm motion, thereby causing downward movement of spigot assembly 20 and valve bridge 18, thus opening exhaust valve 24. Point 186 (FIG. 5B) represents a reset point where the rocker arm assembly 12 begins to reset, such that pass through pin 36 loses contact with the castellation e-foot 86, and oil leaks out from the hydraulic chamber 128. This restores the actuation pin 110 to the default position (FIG. 4A) and restores the engine brake capsule assembly 22 to the unlocked, brake inactive position (see FIG. 11B). At point 188 (FIG. 5B), the rocker arm 14 moves to the closed position as the cam lift profile 32 returns to base circle.

Figure 13:
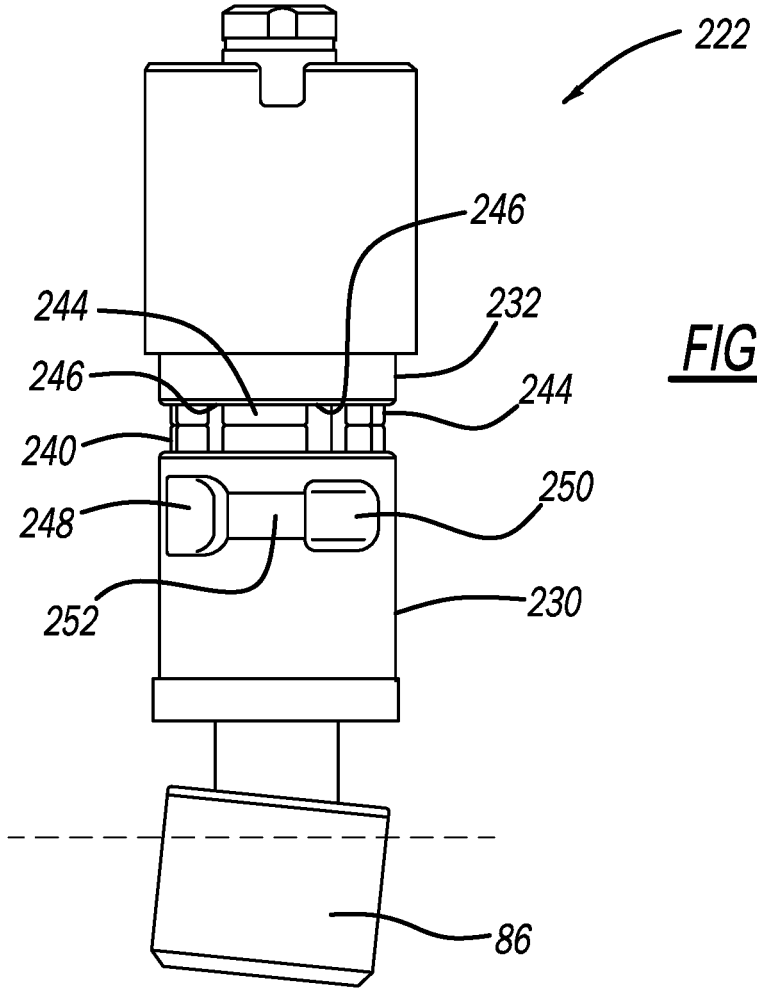
FIG. 13 is a perspective view of another example engine brake capsule assembly that may be utilized with the rocker arm shown in FIG. 1.
Figure 14:
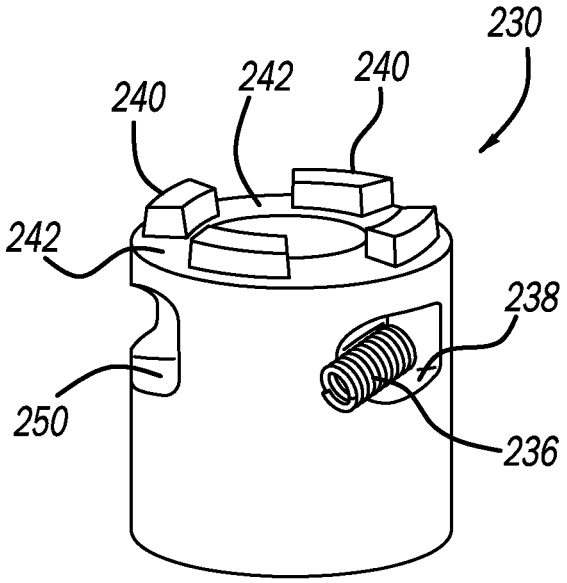
FIG. 14 is a perspective view of an example castellation member of the engine brake capsule assembly shown in FIG. 13.

FIGS. 13 and 14 illustrate another example engine brake capsule assembly 222 that may be utilized with the rocker arm 14. The engine brake capsule assembly 222 is hydraulically controlled between a locked position (FIG. 13) and an unlocked position (not shown) that enables the engine brake capsule assembly to collapse. In the example embodiment, the engine brake capsule assembly 222 generally includes a first castellation member 230, a second castellation member 232 and a castellation biasing member 236 (FIG. 14).

The castellation biasing member 236 is configured to bias the first and second castellation members 230 and 232 into a desired relative rotation therebetween (e.g., the locked position). More specifically, first castellation member 230 includes a recess or bore 238 formed therein and configured to receive one end of the castellation biasing member 236. As such, bore 238 provides a guide to the castellation biasing member 236. The other end of the castellation biasing member 236 can be received in rocker arm body 14 (e.g., a machined bore), which supports retraction of the castellation biasing member 236.

As discussed, the first and second castellation members 230 and 232 are configured to move between the locked, brake active position and the unlocked, brake inactive position. The first castellation member 230 has a series of first teeth 240 and first valleys 242, and the second castellation member 232 has a series of second teeth 244 and second valleys 246. In the example embodiment, first castellation member includes four first teeth 240, and castellation member 232 includes four second teeth 244. However, it will be appreciated that first and second castellation members 230, 232 can include any suitable number of teeth 240, 244 that enable assembly 222 to function as described herein. For example, first and second castellation members 230, 232 may each include between three and eight teeth.

As shown in FIG. 13, the first castellation member 230 includes a pair of opposed oil chambers 248, 250 connected by a port 252. Pressurized fluid is supplied to the oil chambers 248, 250, for example via a hydraulic port formed in the rocker arm 14, to selectively rotate the first castellation member 230 relative the second castellation member 232 to move between the locked and unlocked positions. The two chambers 248, 250 enable increased pressure creation on the chamber walls and thus faster actuation response time. The fluid can be pressurized engine oil or other hydraulic fluid.

In the example embodiment, a latch pin function is integrated into the first castellation member 230. As such, a separate latch pin is not needed for engine brake capsule assembly 222. With such a compact structure, rocker arm size for an oil actuation chamber is reduced. Additionally, the number of parts in the actuation assembly are reduced. As such, the first castellation member 230 acts as a latch pin due to the compounded oil chambers 248, 250 providing more pressure resisting area for actuation purposes in a compact space, which enables a quicker response time. Moreover, because oil chambers 248, 250 are formed in the body of castellation member 230, less space is required in the rocker arm 14 for an oil chamber to generate sufficient actuation pressure.

Moreover, a castellation retraction function is integrated into the first castellation member 230 with the castellation biasing member 236 and circular bore/guide 238, which reduces complexity of the first castellation member design and prevents or reduces unnecessary stress concentration geometry/shape creations.

As shown in FIG. 13, in the example embodiment, the engine brake capsule assembly 222 includes castellation members 230, 232 with teeth 240, 244 contacting one above the other. In some examples, the width of teeth 240, 244 are equal to or substantially equal to each other, thereby preventing or eliminating a cantilever load transfer scenario that can result in bending stresses. As a result, overall life is improved and fatigue reduced.

Figure 15:
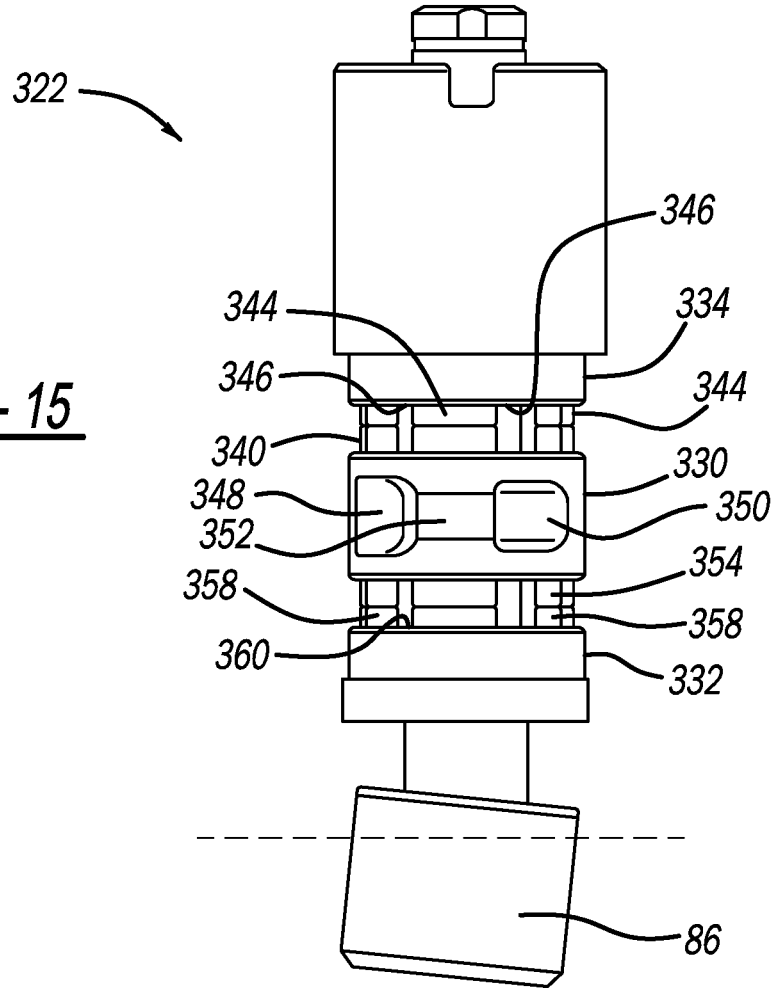
FIG. 15 is a perspective view of yet another example engine brake capsule assembly that may be utilized with the rocker arm shown in FIG. 1.
Figure 16:
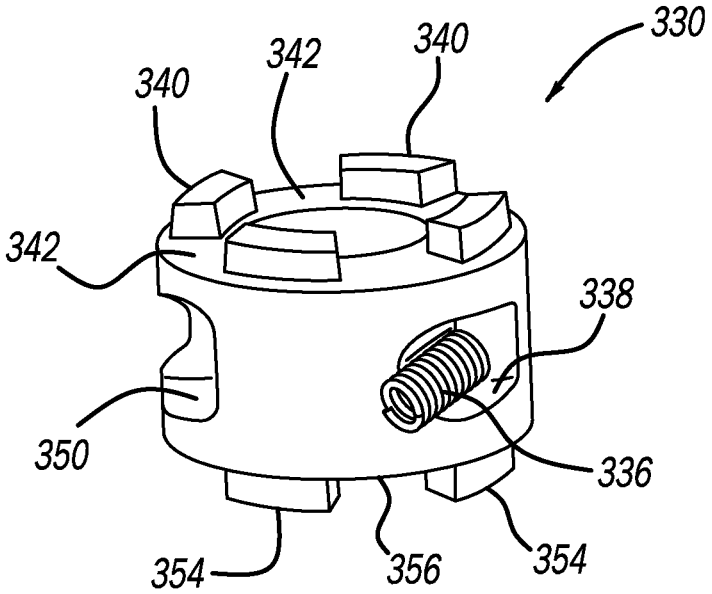
FIG. 16 is a perspective view of an example castellation member of the engine brake capsule assembly shown in FIG. 15.

FIGS. 15 and 16 illustrate another example engine brake capsule assembly 322 that may be utilized with the rocker arm 14. The engine brake capsule assembly 322 is hydraulically controlled between a locked position (FIG. 15) and an unlatched position (not shown) that enables the engine brake capsule assembly to collapse. In the example embodiment, the engine brake capsule assembly 322 generally includes a first castellation member 330, a second castellation member 332, a third castellation member 334, and a castellation biasing member 336 (FIG. 16).

In the example embodiment, the castellation biasing member 336 is configured to bias the first and second castellation members 330 and 332 into a desired relative rotation therebetween (e.g., the locked position). The first castellation member 330 is similar to castellation member 230 and includes a recess or bore 338 formed therein configured to receive one end of the castellation biasing member biasing member 336. As such, bore 338 provides a guide to the castellation biasing member 336. The other end of the castellation biasing member 336 can be received in rocker arm body 14 (e.g., a machined bore), which supports retraction of the castellation biasing member 336.

The first and second castellation members 330 and 332 are configured to move between the locked, brake active position and the unlocked, brake inactive position. In the example embodiment, the first castellation member 330 has a series of first teeth 340 and first valleys 342, and the second castellation member 332 has a series of second teeth 344 and second valleys 346. In the example embodiment, first castellation member includes four first teeth 340, and castellation member 332 includes four second teeth 344. However, it will be appreciated that first and second castellation members 330, 332 can include any suitable number of teeth 340, 344 that enable assembly 322 to function as described herein. For example, first and second castellation members 330, 332 may each include between three and eight teeth.

As shown in FIG. 15, the first castellation member 330 includes a pair of opposed oil chambers 348, 350 connected by a port 352. Pressurized fluid is supplied to the oil chambers 348, 350, for example via a hydraulic port formed in the rocker arm 14, to selectively rotate the first castellation member 330 relative the second castellation member 332 to move between the locked and unlocked positions. The two chambers 348, 350 enable increased pressure creation on the chamber walls and thus faster actuation response time. The fluid can be pressurized engine oil or other hydraulic fluid.

The first and third castellation members 330 and 334 are configured to move between the locked, brake active position and the unlocked, brake inactive position. In the example embodiment, the first castellation member 330 has a series of third teeth 354 and third valleys 356, and the third castellation member 334 has a series of fourth teeth 358 and fourth valleys 360. It will be appreciated that first and third castellation members 330, 334 can include any suitable number of teeth 354, 358 that enable assembly 322 to function as described herein.

In the example embodiment, a latch pin function is integrated into the first castellation member 330. As such, a separate latch pin is not needed for engine brake capsule assembly 322. With such a compact structure, rocker arm size for an oil actuation chamber is reduced. Additionally, the number of parts in the actuation assembly are reduced. As such, the first castellation member 330 acts as a latch pin due to the compounded oil chambers 348, 350 providing more pressure resisting area for actuation purposes in a compact space, which enables a quicker response time. Moreover, because oil chambers 348, 350 are formed in the body of castellation member 330, less space is required in the rocker arm 14 for an oil chamber to generate sufficient actuation pressure.

Moreover, a castellation retraction function is integrated into the first castellation member 330 with the castellation biasing member 336 and circular bore/guide 338, which reduces complexity of the first castellation member design and prevents or reduces unnecessary stress concentration geometry/shape creations. Further, due to the three castellation members 330, 332, and 354, the engine brake capsule assembly 322 is configured to provide a larger lift than previously known designs.

It will be appreciated that the rocker arm 14 having engine brake capsule assemblies 222, 322 operates in a manner similar to that described with rocker arm 14 and engine brake capsule assembly 22 between the drive mode and brake mode.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An engine brake rocker arm assembly operable in an engine drive mode and an engine braking mode, the engine brake rocker arm assembly selectively opening first and second exhaust valves and comprising:

an exhaust rocker arm configured to rotate about a rocker shaft on an axis of rotation;

a bore formed in the exhaust rocker arm and extending transversely across a body of the exhaust rocker arm in a direction parallel to the axis of rotation;

an engine brake capsule assembly movable between (i) a locked position configured to perform an engine braking operation, and (ii) an unlocked position that does not perform the engine braking operation; and a hydraulically controlled actuator assembly including an actuator pin disposed within the bore and engaging the engine brake capsule assembly, the actuator pin configured to translate within the bore to selectively move the engine brake capsule assembly between the locked and second unlocked positions.

2. The engine brake rocker arm assembly of claim 1, wherein the engine brake capsule assembly comprises a first castellation member, a second castellation member, and a castellation biasing member that biases the first and second castellation members apart.

3. The engine brake rocker arm assembly of claim 2, wherein the first castellation member comprises a series of first teeth and first valleys, and wherein the second castellation member comprises a series of second teeth and second valleys.

4. The engine brake rocker arm assembly of claim 3, wherein the first teeth and second teeth have the same width.

5. The engine brake rocker arm assembly of claim 3, wherein the first series of first teeth oppose the sccond series of second teeth in the locked position during the engine brake mode, and wherein the sccond series of second teeth align with the first valleys in the unlocked position during the engine drive mode.

6. The engine brake rocker arm assembly of claim 5, wherein the first castellation member rotates relative to the second castellation member when moving from the unlocked position to the locked position.

7. The engine brake rocker arm assembly of claim 5, wherein the first and second castellation members are configured to collapse toward each other during the unlocked position.

8. The engine brake rocker arm assembly of claim 3, wherein the engine brake capsule assembly further comprises a third castellation member.

9. The engine brake rocker arm assembly of claim 8, wherein the first castellation member comprises a series of third teeth and third valleys, and wherein the third castellation member comprises a series of fourth teeth and fourth valleys.

10. The engine brake rocker arm assembly of claim 9, wherein the series of third teeth oppose the fourth series of fourth teeth in the locked position during the engine brake mode, and wherein the fourth series of fourth teeth align with the third valleys in the unlocked position during the engine drive mode.

11. The engine brake rocker arm assembly of claim 1, wherein a hydraulic chamber is defined in the bore between the actuator pin and the rocker arm.

12. The engine brake rocker arm assembly of claim 11, wherein the hydraulic chamber is fluidly coupled to a source of hydraulic fluid to selectively move the actuator pin between a first position that corresponds to the engine brake capsule assembly locked position, and a second position that corresponds to the engine brake capsule assembly unlocked position.

13. The engine brake rocker arm assembly of claim 11, wherein the actuator assembly further comprises a plug disposed in one end of the bore, and the actuator pin extends at least partially through the plug.

14. The engine brake rocker arm assembly of claim 11, wherein the actuator pin includes a first seal, a second seal, and an annular flange, wherein the annular flange is configured to be received within a slot formed in the engine brake capsule assembly, wherein translation of the actuator pin in the bore translates the annular flange to thereby rotate a first castellation member of the engine brake capsule assembly.

15. The engine brake rocker arm assembly of claim 1, further comprising a lost motion spigot assembly at least partially disposed within a bore formed in the rocker arm.

16. The engine brake rocker arm assembly of claim 15, wherein the lost motion spigot assembly comprises:

a guide;

a shaft extending through the guide; and a lost motion biasing mechanism seated between the guide and a wall of the rocker arm forming the bore.

17. The engine brake rocker arm assembly of claim 16, wherein the lost motion spigot assembly further comprises a nut threadably secured to a first end of the shaft to enable mechanical lash adjustment, and an e-foot operably associated with a second end of the shaft.

18. The engine brake rocker arm assembly of claim 1, wherein the engine brake capsule assembly is disposed within a bore formed in the rocker arm and comprises:

a retainer;

a lash adjustment screw;

a first castellation member;

a second castellation member operatively associated with the first castellation member;

a castellation shaft extending through the retainer, the lash adjustment screw, and the first and second castellation members; and a castellation biasing mechanism disposed between the first and second castellation members and configured to bias the first and second castellation members apart.

19. The engine brake rocker arm assembly of claim 18, wherein the engine brake capsule assembly further comprises a castellation nut coupled to the lash adjustment screw, and wherein the castellation shaft is configured to slide within the lash adjustment screw.

20. A valvetrain assembly comprising:

a first engine valve;

a second engine valve;

a valve bridge operatively associated with the first and second engine valves; and an engine brake rocker arm assembly comprising:

a rocker arm rotatably coupled to a rocker shaft;

lost motion spigot assembly at least partially disposed within a first bore formed in the rocker arm, the lost motion spigot assembly configured to selectively engage the valve bridge to actuate the first and second engine valves;

an engine brake capsule assembly at least partially disposed within a second bore formed in the rocker arm, and movable between (i) a locked position configured to perform an engine braking operation by engaging only the second engine valve, and (ii) an unlocked position that does not perform the engine braking operation; and a hydraulically controlled actuator assembly at least partially disposed within a third bore formed in the rocker arm, and configured to selectively move the engine brake capsule assembly between the locked and second unlocked positions.

* * * * *